US006466104B2

(12) United States Patent
Yamashita et al.

(10) Patent No.: US 6,466,104 B2
(45) Date of Patent: Oct. 15, 2002

(54) HIGH-FREQUENCY CIRCUIT MODULE, FILTER, DUPLEXER, AND COMMUNICATION DEVICE

(75) Inventors: Sadao Yamashita, Kyoto; Takatoshi Kato, Mino, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/790,152

(22) Filed: Feb. 21, 2001

(65) Prior Publication Data

US 2001/0028284 A1 Oct. 11, 2001

(30) Foreign Application Priority Data

Feb. 21, 2000 (JP) ..... 2000-042159

(51) Int. Cl.[7] ..... H01P 1/213

(52) U.S. Cl. ..... 333/134; 331/107 SL; 333/219.1; 333/202

(58) Field of Search ..... 333/219.1, 202, 333/219, 134; 331/107 SL

(56) References Cited

U.S. PATENT DOCUMENTS 6,204,739 B1 * 3/2001 Sakamoto et al. ..... 333/219.1

FOREIGN PATENT DOCUMENTS

| | | |
|---|---|---|
| JP | 08265015 | 10/1996 |
| JP | 10145117 | 5/1998 |
| JP | 11214908 | 8/1999 |

OTHER PUBLICATIONS

Article: Proceedings of the 1997 Electronics Society Conference of IEICE.

* cited by examiner

*Primary Examiner*—Benny Lee
*Assistant Examiner*—Stephen E. Jones
(74) *Attorney, Agent, or Firm*—Ostrolenk, Faber, Gerb & Soffen, LLP

(57) ABSTRACT

A first electrode layer having a first electrodeless portion is formed on the upper surface of a dielectric plate, a second electrode layer having a second electrodeless portion opposing the first electrodeless portion is forced on the lower surface of a second dielectric plate, and electric lines are formed by an intermediate electrode layer formed between the first and second electrode layers.

18 Claims, 7 Drawing Sheets

HIGH-FREQUENCY CIRCUIT MODULE, FILTER, DUPLEXER, AND COMMUNICATION DEVICE

BACKGROUND OF THE INVENTION

1. Field of the Invention

The present invention relates to a high-frequency circuit module such as an oscillator, filter, duplexer, etc., to be used in microwave bands and millimeter wave bands, and a communication device using the module.

2. Description of the Related Art

The inventor disclosed in Japanese Unexamined Patent Application Publication No. 8-265015 that by providing electrodes having electrodeless portions opposing each other on both surfaces of a dielectric substrate, a TE010 mode resonator can be formed in an area sandwiched between the two electrodeless portions and its vicinity in the dielectric substrate.

Furthermore, in Program C2-68 in the IEICE Electronics Society Conference (September, 1997), Japanese Unexamined Patent Application Publication No. 11-214908, and Japanese Unexamined Patent Application Publication No. 10-145117, a high-frequency circuit module such as a filter, oscillator, etc., using the above TE010 mode resonator is disclosed.

In the high-frequency circuit module using the above-mentioned conventional TE010 mode resonator, by stacking a resonator substrate constituting the TE010 mode resonator on a front side of a circuit substrate having lines formed thereon or on the back side of the circuit substrate, the lines on the circuit substrate are coupled to the above-mentioned resonator.

However, when a resonator substrate constituting a resonator is mounted on the back side of a circuit substrate, the electrodes on the resonator substrate may be placed in contact with the grounding electrode on the circuit substrate by a leaf spring and they may be joined using a conductive adhesive. In such a case, it has been feared that the contacting condition between the electrodes may change because of temperature variations and changes with time, the coupling between lines on the circuit substrate and the resonator may become unstable, and the characteristics may thereby be changed.

Furthermore, in the construction in which the above resonator substrate is mounted on a circuit substrate, it may be required to arrange the substrates separated by a spacer so that the electrodes on the back side of the resonator substrate may not come into contact with the lines on the circuit substrate, etc.

Now, the degree of coupling of a resonator provided on the above resonator substrate with a line on the circuit substrate is proportional to a magnitude of magnetic flux of a resonance mode at the location of the line on the circuit substrate. But because much of the resonance energy of the resonator is confined inside the resonator substrate, it is difficult to obtain a high degree of coupling to the line on the circuit substrate, existing outside the resonator substrate. Furthermore, in order to increase the degree of coupling, the line on the circuit substrate may be arranged so as to be closer to the middle of the resonator, but because of that, it is feared that the electromagnetic field of the resonance mode may be disturbed, the Q value may be degraded, and an unwanted resonance mode may be induced.

SUMMARY OF THE INVENTION

In view of the foregoing problems, the present invention provides a high-frequency circuit module in which a degree of coupling of a line to a resonator composed of a dielectric layer sandwiched between electrode layers can be easily increased, reliability is improved, a spacer, etc., is made unnecessary, and a high Q value is obtained so that unwanted modes are not generated.

The invention further provides an oscillator, a filter, and a duplexer, and a communication device using them, by utilizing the construction of the above high-frequency circuit module.

In a high-frequency circuit module according to an embodiment of the present invention, electrodeless portions opposing each other are provided in two electrode layers with a dielectric layer sandwiched therebetween, at least one intermediate electrode layer is provided between the two electrode layers, and an electric line coupled to a resonance mode generated in an area sandwiched between the two electrodeless portions and its vicinity is formed in the intermediate electrode layer.

Because of this construction, a resonance mode generated in a resonance area sandwiched between the electrodeless portions opposing each other and the line in the intermediate electrode layer are coupled. As the line is inside the resonance area where a strong resonance energy is confined, a high degree of coupling can be realized.

Furthermore, in a high-frequency circuit module according to an embodiment of the present invention, part of the intermediate electrode layer may be exposed and, for example, mounting parts to be electrically connected to the above line may be disposed on the module. Because of this construction, mounting parts can be easily mounted and connected to a line coupled to the above resonator constructed in an area sandwiched between electrodeless portions opposing each other.

Furthermore, in a high-frequency circuit module according to an embodiment of the present invention, at least one of the two electrode layers may be provided with an electrode connected to electrodes in the intermediate electrode layer and mounting parts may be disposed on the electrode. Because of this construction, without requiring any particular processing of a multilayer substrate containing a plurality of dielectric layers, mounting parts can be mounted on one side of a substrate and accordinglyproductivity can be improved.

Furthermore, in a high-frequency circuit module according to an embodiment of the present invention, a through-hole may connect at least the two electrode layers formed in the dielectric layer. In this way, the through-hole portion inside the dielectric layer is at the same electric potential as the two electrode layers which are at the ground electric potential, and spurious modes such as parallel-plate modes being propagated between the above electrode layers, etc., are suppressed.

Furthermore, in a high-frequency circuit module according to an embodiment of the present invention, the lateral width of the two dielectric layers sandwiched between the two electrode layers and the intermediate electrode layer can be made different from each other. Because of this construction, as the resonator in the area in which the above two electrode layers oppose each other is provided only in the resonance area sandwiched between the two electrode layers, the frequency of spurious modes such as parallel-plate modes, etc., can be shifted to a higher-frequency region where the spurious modes are practically insignificant. Furthermore, because the width of the dielectric layer sandwiched between one electrode layer of the two electrode layers and the intermediate electrode layer has become narrower, the arrangement of electrode patterns and mounting parts on the exposed surface of the other dielectric layer becomes easier, and accordingly higher performance and more mutifunctional products become possible. Furthermore, the adjustment of electrode patterns on the exposed surface by trimming also becomes easier. Moreover, as the amount of dielectric material can be minimized, weight and cost can be reduced.

In an oscillator of the present invention, a reflector amplifier is connected to the electric line in the above high-frequency circuit module.

In a filter of the present invention, part of the electric line in the above high-frequency circuit module is led out as an input-output terminal or an electrode coupled to such an electric line is led outside as an input-output terminal.

In a duplexer of the present invention, a plurality of the resonance areas are provided, and an electric line coupled to resonance modes in two resonance areas is led outside as a common input-output terminal or an electrode coupled to such an electric line is led outside as a common input-output terminal.

In a communication device of the present invention, the above filter or duplexer is used, for example, as a signal processing part or as an antenna sharing unit for conducting a transmission signal or reception signal in a high-frequency circuit.

Other features and advantages of the present invention will become apparent from the following description of embodiments of the invention which refers to the accompanying drawings, in which like references denote like elements and parts.

DETAILED DESCRIPTION OF EMBODIMENTS OF THE INVENTION

The construction of a filter according to a first embodiment will be described with reference to FIGS. 1A, 1B, and 2.

Figure 1A:
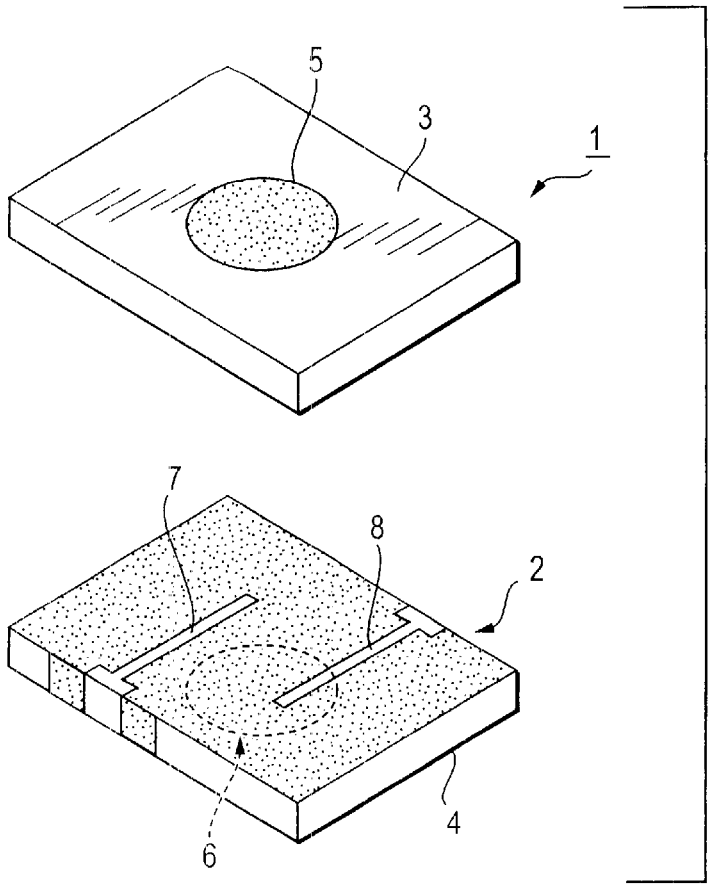
FIGS. 1A and 1B show the construction of a filter according to a first embodiment.

FIG. 1A is an exploded perspective view of the main part of a filter. In FIG. 1A, dielectric plates 1 and 2 are shown. On the upper surface of the dielectric plate 1, a first electrode layer 3 part of which is a circular electrodeless portion 5 is formed. Moreover, the first electrode layer 3 is extended over the four side surfaces of the dielectric plate 1. On the lower surface of the dielectric plate 1 no electrode is formed. FIG. 1B is a bottom view of the dielectric plate 2, and, on the lower surface of the dielectric plate 2, a second electrode layer 4 is formed, having an electrodeless portion 6, which, when the dielectric plate 2 and the dielectric plate 1 are laminated, is in an area opposing the electrodeless portion 5. On the upper surface of the dielectric plate 2, electric lines 7 and 8 are formed. The electrodes such as the lines 7, 8, etc., to be formed on the upper surface of the dielectric plate 2 correspond to "an intermediate electrode" as described in connection with the present invention. The end portions of the lines 7 and 8 are each extended to part of the upper surface of the dielectric plate 2 from one or more of its side surfaces. The four side surfaces of the dielectric plate 2 are covered by the second electrode layer 4 which extends from the lower surface, except where the lines 7 and 8 extend across the respective side surface(s).

After each of the dielectric plates 1 and 2 has been independently fired, the above electrode layers are formed, and then the two plates are laminated (stacked), and they are integrated by baking. In the baking step, wax, conductive adhesive, or silver electrode material is used to integrate the layers. Alternatively, the two layers can be laminated in the form of green sheets and then they can be integrated by firing them after they have been laminated together.

Figure 1B:
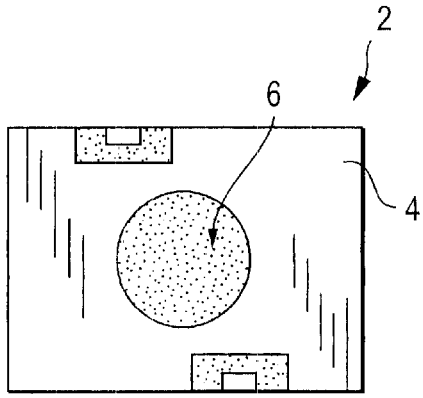

In accordance with the construction shown in FIGS. 1A and 1B, the electrodeless portion 6 on the lower surface and the lines 7 and 8 on the upper surface of the dielectric plate 2 are formed by photolithography to the dielectric plate 2, and accordingly the electrodeless portion and the lines 7 and 8 on the upper surface can be patterned with very high relative positional accuracy.

Figure 2:
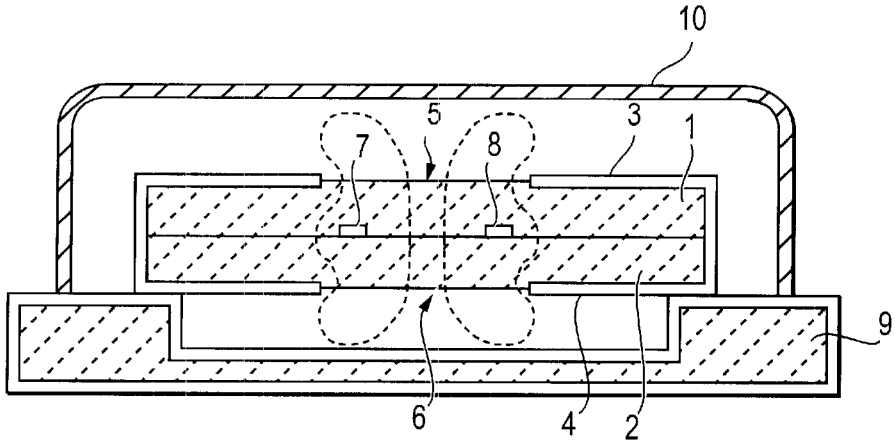
FIG. 2 is a sectional view of the filter according to the first embodiment.

FIG. 2 is a longitudinal sectional view taken in the middle of the above filter. In FIG. 2, a base 9 composed of a ceramic plate with terminal electrodes formed thereon and a metal cap 10 covering the upper portion of the base are shown. In the condition that the two dielectric plates 1 and 2 shown in FIG. 1 are laminated, the dielectric layer of the dielectric plates 1 and 2 sandwiched by the electrodeless portions 5 and 6 becomes a resonance area and functions as a TE010 mode resonator. Furthermore, the laminated body of the above dielectric plates 1 and 2 is mounted on the upper portion of the base 9 and the cap 10 covering the laminated body produces a resonance space and magnetically shields the laminated body.

Moreover, although not shown in FIG. 2, the electrodes led out to the lower surface of the dielectric plate 2 from the lines 7 and 8 are conductively connected to terminal electrodes provided on the base 9 and they are led out to parts of the lower surface of the base 9 across its side surface. In this way, a surface-mountable filter is constructed.

Constructed as described above, the lines 7 and 8 pass through a high magnetic field generated in the TE010 mode and accordingly the lines 7 and 8 can be strongly coupled with the TE010 mode.

Furthermore, the lines 7 and 8 can be provided close to the periphery of the electrodeless portions, and accordingly disturbances in the resonant electromagnetic field caused by the lines 7 and 8 are minimized and loss is reduced in comparison with conventional resonators.

In the example shown in FIGS. 1A and 1B, the end portions of the lines 7 and 8 are directly led outside, but, instead of leading the lines 7 and 8 directly to the outside of the resonator, other lines coupled to the lines 7 and 8 can be led out instead.

Next, the construction of a high-frequency circuit module according to a second embodiment will be described with reference to FIGS. 3 and 4.

Figure 3:
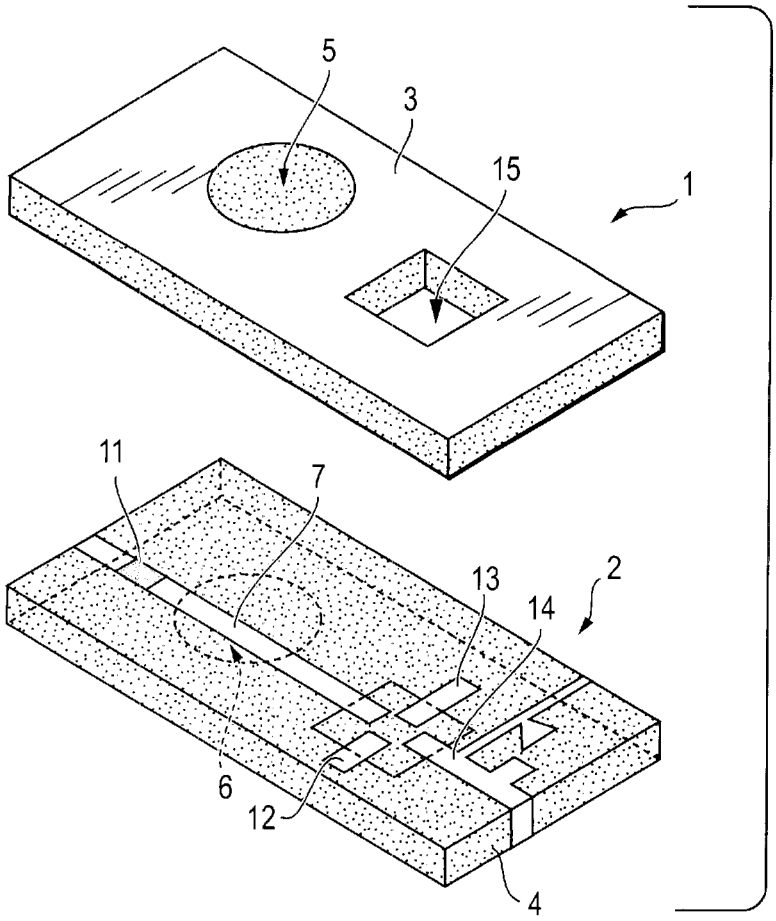
FIG. 3 is an exploded perspective view of a high-frequency circuit module according to a second embodiment.

FIG. 3 is an exploded perspective view of the high-frequency circuit module. In the same way as in the first embodiment, on the upper surface of a dielectric plate 1, a first electrode layer 3 is formed, a fixed area of which is an electrodeless portion 5. On the lower surface of a dielectric plate 2, a second electrode layer 4 is formed, having an electrodeless portion 6 which opposes the above electrodeless portion 5. Then, on the upper surface of the dielectric plate 2, a circuit pattern including a line 7, a thin-film resistor 11, electrodes 12, 13, and 14, etc., is formed. Out of these electrode patterns, the line 7 is coupled to a TE010 mode generated in a resonance area sandwiched between the electrodeless portions 5 and 6, the resonance area being formed when the dielectric plates 1 and 2 are laminated.

As shown in FIG. 3, in the dielectric plate 1, an opening portion 15 is formed so that parts of the line 7 and electrodes 12, 13, and 14 are exposed when the dielectric plate 1 is laminated with the dielectric plate 2.

Figure 4:
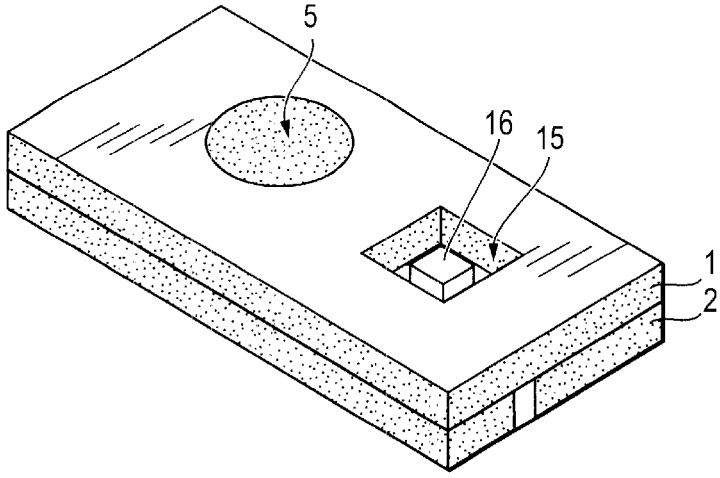
FIG. 4 is a perspective view of the high-frequency circuit module according to the second embodiment.

As shown in FIG. 4, the two dielectric plates 1 and 2 shown in FIG. 3 are laminated and an FET16 (referred to below as a "mounting part") is mounted on the upper surface of the dielectric plate 2 through the opening portion 15. In this way, by making part of the intermediate electrode layer exposed and disposing mounting parts in the exposed area, the connection of the mounting parts to a circuit coupled to the resonator is made easier.

Next, the construction of a high-frequency circuit module according to a third embodiment will be described with reference to FIGS. 5 and 6.

Figure 5:
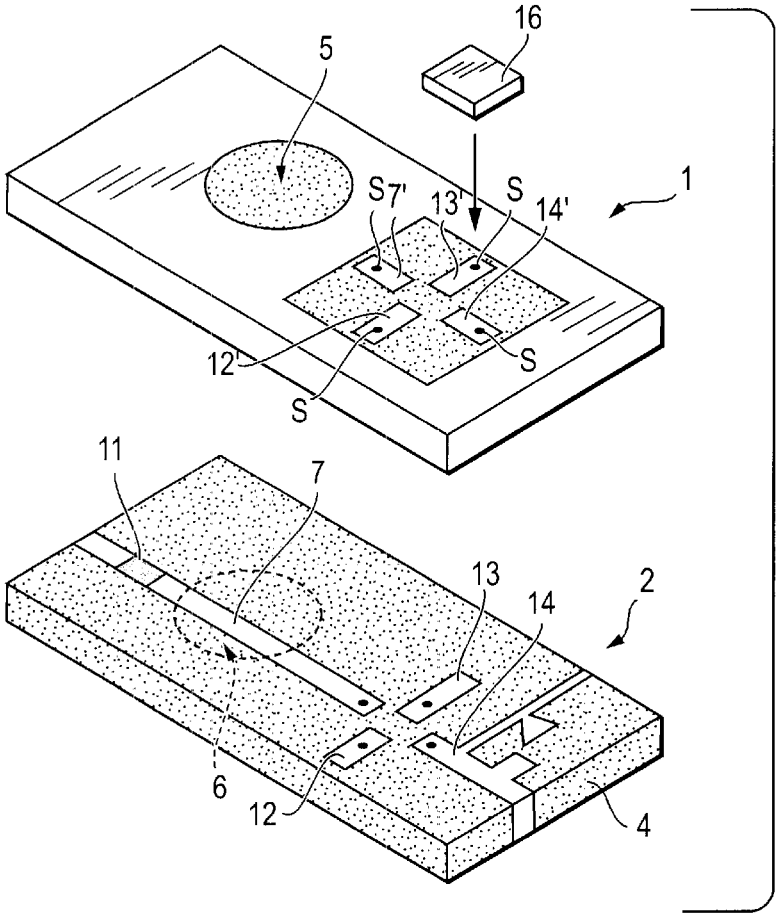
FIG. 5 shows the construction of a high-frequency circuit module according to a third embodiment.
Figure 6:
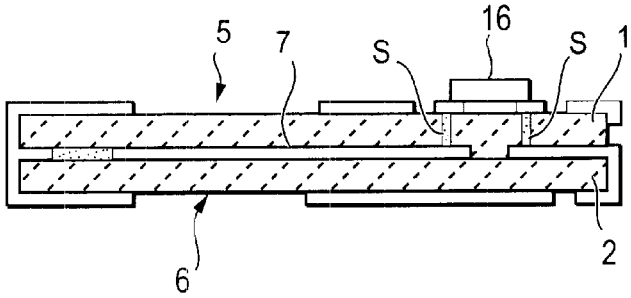
FIG. 6 is a sectional view of the high-frequency circuit module, as a filter, according to the third embodiment.

FIG. 5 is an exploded perspective view of the high-frequency circuit module and FIG. 6 is a sectional view of the main part of the module. The difference between FIGS. 5–6 and FIGS. 3–4 is that, instead of providing an opening portion in the dielectric plate 1, through-holes which are conductively connected to electrodes on the upper surface of the dielectric plate 2 are provided, and the mounting parts are mounted on the upper surface of the dielectric plate 1. That is, in FIG. 5, through-holes S are shown, the through-holes S are connected to a line 7 and electrodes 12, 13, and 14, and the line 7 and electrodes 12, 13, and 14 are led out to electrodes 7', 12', 13', and 14' on the upper surface of the dielectric plate 1. A FET 16 is connected to each of the electrodes 7', 12', 13', and 14' on the upper surface of the dielectric plate 1.

Next, the construction of a high-frequency circuit module according to a fourth embodiment will be described with reference to FIGS. 7 and 8.

Figure 7:
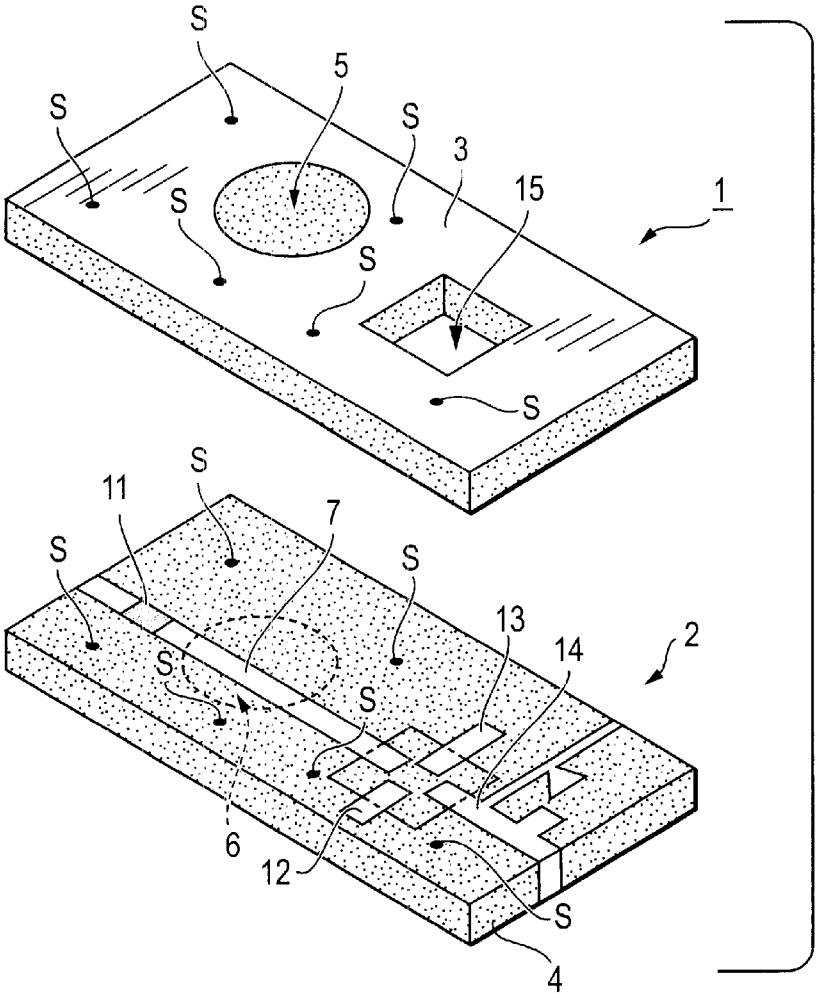
FIG. 7 shows the construction of a high-frequency circuit module according to a fourth embodiment.
Figure 8:
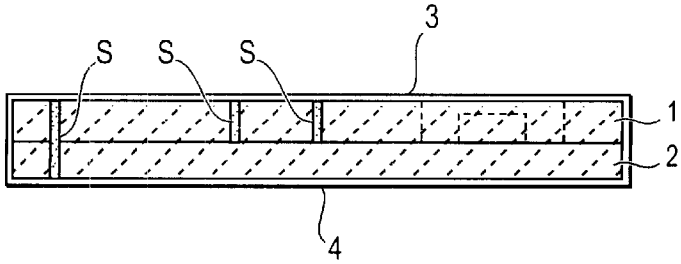
FIG. 8 is a sectional view of the high-frequency circuit module, as a filter, according to the fourth embodiment.

FIG. 7 is an exploded perspective view of the high-frequency circuit module, and FIG. 8 is a sectional view of the main part of the module. What is different from the construction shown in FIG. 3 is that fixed locations on the first electrode layer 3 formed on the upper surface of the dielectric plate 1 and on the second electrode layer 4 formed on the lower surface of a dielectric plate 4 are connected to each other by through-holes S.

Thus, by making connections at fixed locations by means of the through-holes between the first and second electrode layers, spurious modes such as parallel-plate modes generated between the first and second electrode layer, etc., can be suppressed and the operation can be stabilized.

Next, the construction of a high-frequency circuit module according to a fifth embodiment will be described with reference to FIGS. 9 and 10.

Figure 9:
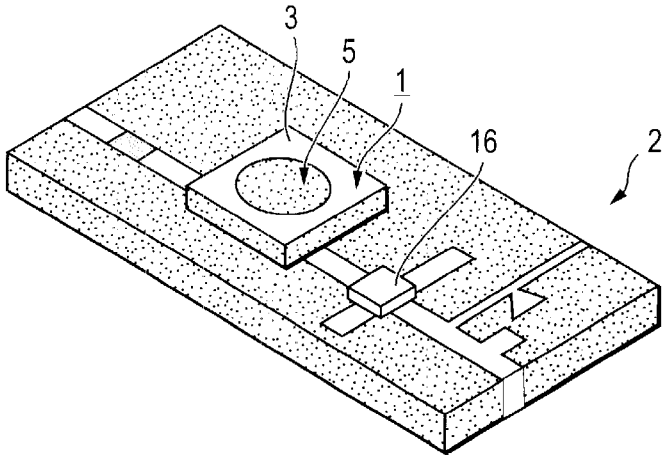
FIG. 9 shows the construction of a high-frequency circuit module according to a fifth embodiment.
Figure 10:
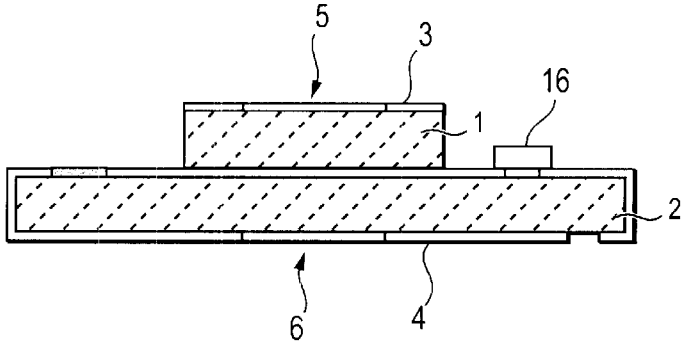
FIG. 10 is a sectional view of the high-frequency circuit module, as a filter, according to the fifth embodiment.

FIG. 9 is a perspective view of the module, and FIG. 10 is a sectional view of the main part of the module. In this example, in a dielectric plate 1, a first electric layer 3, approximately the center portion of which is made an electrodeless portion is provided, and the longitudinal and transversal width of the dielectric plate 1 are made narrower than the width of a dielectric plate 2. On the lower surface of the dielectric plate 2, a second electrode layer 4 is formed, having an electrodeless portion 6 in an area opposing the electrodeless portion 5. In this way, the area sandwiched between the upper and lower electrodeless portions and its vicinity are made to function as a resonance area of a TE010 mode. In an exposed portion on the upper surface of the dielectric plate 2, mounting parts such as an FET16, etc., are disposed.

By making the longitudinal and transversal width of the dielectric plate 1 as narrow as the above resonance area, the longitudinal and transversal width of the area sandwiched between the first and second electrode layer are reduced and accordingly spurious modes generated in the area are shifted to a higher-frequency region. Because of that, responses to the spurious modes are made farther from a frequency band to be used, and the module becomes hardly affected by spurious modes. Furthermore, by making one dielectric plate narrower than another and by arranging mounting parts on the exposed area of the other dielectric plate, many mounting parts can be disposed on the other dielectric plate and the high-frequency circuit module becomes of higher-performance and more multifunctional. Moreover, because the amount of dielectric material to be used is reduced to a minimal requirement, lighter weight and lower cost become possible.

Next, the construction of a duplexer according to a sixth embodiment will be described with reference to FIG. 11.

Figure 11A:
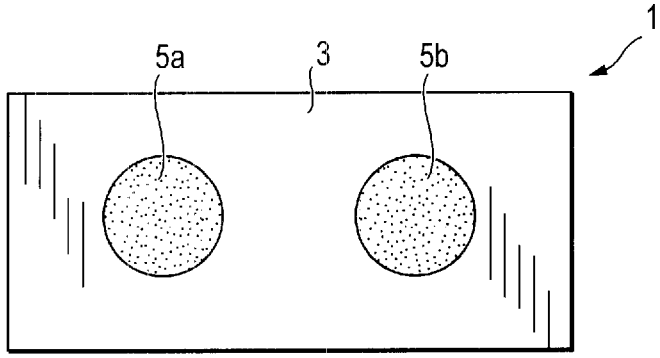
FIGS. 11A, 11B, and 11C show the construction of a duplexer according to a sixth embodiment.
Figure 11B:
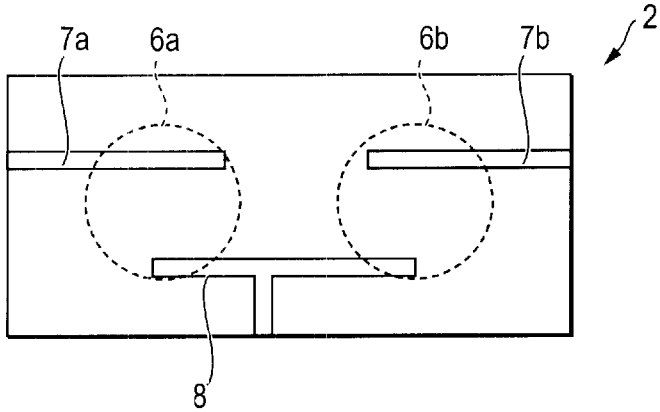
Figure 11C:
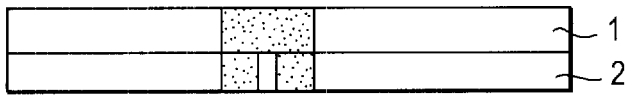

FIG. 11A is a top view of an upper dielectric plate, FIG. 11B is a top view of a lower dielectric plate, and FIG. 11C is a rear elevation of a duplexer made up of two laminated dielectric plates. On the upper surface of the dielectric plate 1, a first electrode layer 3 having two electrodeless portions 5*a* and 5*b* is formed. On the lower surface, no electrode is formed. On the upper surface of the dielectric plate 2, lines 7*a*, 7*b*, and 8 are formed, and on the lower surface is formed a second electrode layer in which electrodeless portions 6*a* and 6*b* are formed in areas opposing the above electrodeless portions 5*a* and 5*b*. When these upper and lower dielectric plates 1 and 2 are laminated, the line 7*a* is coupled to a resonance mode in the area sandwiched between the electrodeless portions 5*a* and 6*a* and its vicinity, and the line 7*b* is coupled to the resonance mode in the area sandwiched between the electrodeless portions 5*a* and 6*a* and its vicinity. Furthermore, the line 8 is coupled to each of the above two resonance modes. The end portion of the lines 7*a* and 7*b* are led to parts of the lower surface across side surfaces of the dielectric plate 2, respectively. Furthermore, a fixed location of the line 8 is led to part of the lower surface across a side surface of the dielectric plate 2. Here, the end portion of the line 7*a* is used as an input terminal for a transmission signal, the end portion of the line 7*b* is used as an output terminal for a reception signal, and the end portion of a line branched off from the line 8 is used as an antenna terminal.

Thus, a duplexer in which one-stage resonators are used as a transmission filter and a reception filter respectively is constructed.

In the example shown in FIGS. 11A, 11B, and 11C, only two resonators are provided, but by arranging a plurality of pairs of opposing electrodeless portions and by coupling neighboring resonators, a transmission filter and a reception filter may be composed of a plurality of stages of resonators. Furthermore, in the example shown in FIGS. 11A, 11B, and 11C, the end portion of each line is directly led to the outside, but by providing other lines which are coupled to the lines coupling with resonators, respectively, these other lines may be led to the outside instead.

Next, the construction of an oscillator according to a seventh embodiment will be described with reference to FIG. 12.

Figure 12:
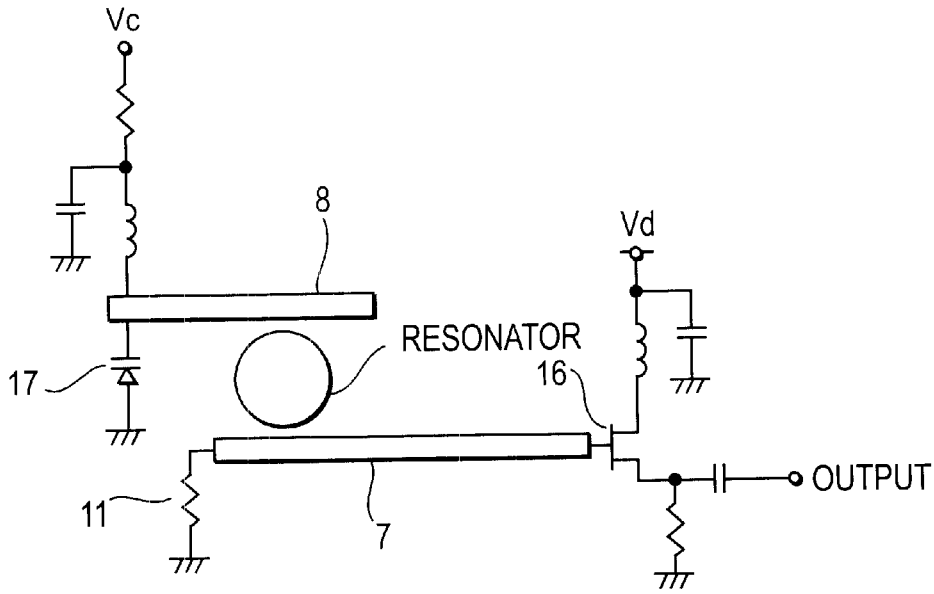
FIG. 12 is an equivalent circuit diagram of an oscillator according to a seventh embodiment.

FIG. 12 is an equivalent circuit diagram of an embodiment of an oscillator which is constructed using one of the high-frequency circuit modules shown in FIGS. 3 to 10. In FIG. 12, the resonator is a TE010 mode resonator constructed in the area sandwiched between the above-mentioned two electrodeless portions and its vicinity, and lines 7 and 8 are provided in an intermediate electrode layer passing between a first electrode layer and a second electrode layer and are coupled to the resonator. One end of the line 7 is terminated by a thin film resistor 11 shown in the drawing, and to the other end portion the gate of a FET 16 is connected. To the drain of the FET 16, a bias voltage Vd is applied through an equivalent circuit of an inductor and a capacitor. To the source of the FET 16, a resistor one end of which is grounded is connected, and from the source an oscillation signal is output through a capacitor. To the line 8, a variable reactance element 17 such as a varactor diode, etc., is connected and a circuit for supplying a control voltage Vc to the variable reactance element 17 is connected.

Because of such a circuit construction, the FET 16 functions as a reflector amplifier and a band-reflection type oscillation circuit is composed of the amplifier, the line 7, and the resonator. Furthermore, in this example, by changing the control voltage Vc to the variable reactance element 17, the capacitance is changed and the capacitance component loaded in the resonator is changed, and thus the resonance frequency is altered. In this way, as a result, the oscillation frequency is voltage-controlled.

As described above, because the lines 7 and 8 are strongly coupled to the resonator, a wide oscillation frequency range corresponding to the adjustable range of reactance of the variable reactance component 17 can be obtained.

Next, the construction of a communication device according to an eighth embodiment will be described with reference to FIG. 13. In the drawing, an transmitter-receiver antenna ANT, a duplexer DPX, bandpass filters BPFa, BPFb, and BPFc, amplifiers AMPa and AMPb, mixers MIXa and MIXb, an oscillator OSC, and a divider DIV are shown. A voltage-controlled oscillator VCO modulates an oscillation frequency by a signal in accordance with a transmission signal, that is, transmission data.

The mixer MIXa mixes a signal modulated by the voltage-controlled oscillator VCO and a signal output from the oscillator OSC and distributed by the divider DIV, and the bandpass filter BPFa passes only the transmission frequency band out of a mixed output signal from the mixer MIXa, and the amplifier AMPa power-amplifies the transmission frequency band signal and transmits the signal from the transmitter-receiver antenna ANT through the duplexer DPX. The bandpass filter BPFb passes only the reception frequency band out of a reception signal to be output from the duplexer DPX, and the amplifier AMPb amplifies the reception frequency band signal. The mixer MIXb mixes the reception signal and a frequency signal which is output from the oscillator OSC, distributed by the divider DIV, and output from the bandpass filter BPFc, and outputs an intermediate-frequency (IF) signal.

Figure 13:
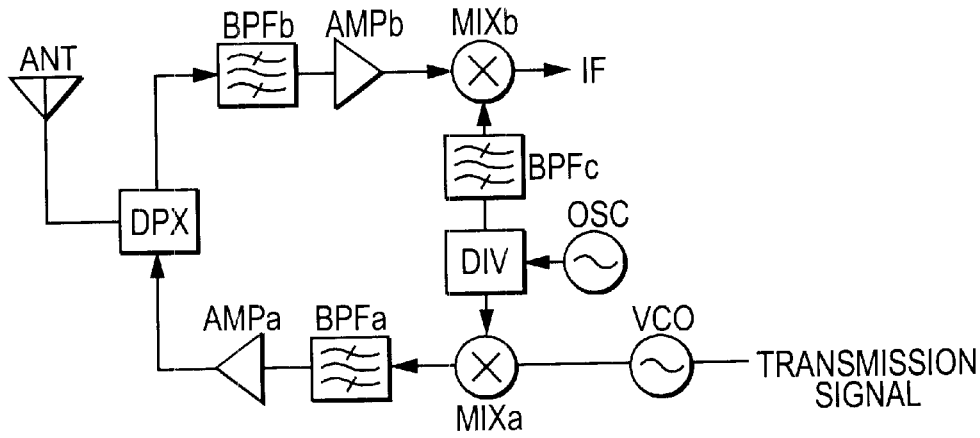
FIG. 13 is a block diagram showing the construction of a communication device according to a eighth embodiment.

In the duplexer DPX shown in FIG. 13, a duplexer constructed as in FIGS. 11A, 11B, and 11C may be used. Furthermore, in the bandpass filters BPFa, BPFb, and BPFc, a dielectric filter constructed as in FIGS. 1A, 1B, and 2 may be used. Furthermore, in the voltage-controlled oscillator VCO, a voltage-controlled oscillator shown in FIG. 12 may be used.

In this way, by using filters and duplexers of high reliability and low insertion loss and by using voltage-controlled oscillators having excellent C/N characteristics, a communication device of small size which is excellent in high-frequency circuit characteristics is obtained.

While the invention has been particularly shown and described with reference to embodiments thereof, it will be understood by those skilled in the art that the foregoing and other changes in form and details can be made without departing from the spirit and scope of the invention.

What is claimed is:

1. A high-frequency circuit module comprising:

electrodeless portions opposing to each other provided in two electrode layers with a dielectric layer sandwiched therebetween;

at least one intermediate electrode layer provided between the two electrode layers; and an electric line coupled to a resonance mode generated in an area sandwiched between the two electrodeless portions and its vicinity formed in the intermediate electrode layer.

2. A high-frequency circuit module as claimed in claim 1, wherein a portion of the intermediate electrode layer is exposed and mounting parts are disposed on the exposed portion.

3. A high-frequency circuit module as claimed in claim 2, wherein the dielectric layer sandwiched between the two electrode layers comprises two dielectric layers, and the area of one of said two dielectric layers is smaller than the area of the other.

4. A high-frequency circuit module as claimed in claim 2, wherein a through-hole conductively connecting at least the two electrode layers is formed in the dielectric layer.

5. A high-frequency circuit module as claimed in claim 4, wherein the dielectric layer sandwiched between the two electrode layers comprises two dielectric layers, and the area of one of said two dielectric layers is smaller than the area of the other.

6. A high-frequency circuit module as claimed in claim 1, wherein at least one of the two electrode layers is provided with a mounting electrode connected to an electrode in the intermediate electrode layer and a mounting part is disposed on the mounting electrode.

7. A high-frequency circuit module as claimed in claim 6, wherein the dielectric layer sandwiched between the two electrode layers comprises two dielectric layers, and the area of one of said two dielectric layers is smaller than the area of the other.

8. A high-frequency circuit module as claimed in claim 6, wherein a through-hole conductively connecting at least the two electrode layers is formed in the dielectric layer.

9. A high-frequency circuit module as claimed in claim 8, wherein the dielectric layer sandwiched between the two electrode layers comprises two dielectric layers, and the area of one of said two dielectric layers is smaller than the area of the other.

10. A high-frequency circuit module as claimed in claim 1, wherein a through-hole conductively connecting at least the two electrode layers is formed in the dielectric layer.

11. A high-frequency circuit module as claimed in claim 10, wherein the dielectric layer sandwiched between the two electrode layers comprises two dielectric layers, and the area of one of said two dielectric layers is smaller than the area of the other.

12. A high-frequency circuit module as claimed in claim 1, wherein the dielectric layer sandwiched between the two electrode layers comprises two dielectric layers, and the area of one of said two dielectric layers is smaller than the area of the other.

13. An oscillator comprising a reflector amplifier connected to the electric line in a high-frequency circuit module as claimed in any of claims 1, 2, 6, 10 or 12.

14. A communication device comprising a component which includes an oscillator as claimed in claim 13, and a high-frequency circuit comprising at least one of a transmitting circuit and a receiving circuit connected to said component.

15. A filter comprising a high-frequency circuit module as claimed in any of claims 1, 2, 6, 10, or 12 wherein an electrode associated with said electric line is led outside as an input-output terminal.

16. A duplexer comprising:

a pair of filters, each as claimed in claim 15; and part of an electric line coupled to a resonance mode in each of said pair of filters, and an electrode associated with said electric line being led outside as a common antenna input-output terminal.

17. A communication device comprising a component which includes a duplexer as claimed in claim 16, and a high-frequency circuit comprising at least one of a transmitting circuit and a receiving circuit connected to said component.

18. A communication device comprising a component which includes a filter as claimed in claim 15, and a high-frequency circuit comprising at least one of a transmitting circuit and a receiving circuit connected to said component.

* * * * *